US008884832B2

(12) United States Patent
Huang et al.

(10) Patent No.: US 8,884,832 B2
(45) Date of Patent: Nov. 11, 2014

(54) INDOOR CEILING-MOUNT OMNIDIRECTIONAL ANTENNA AND A METHOD FOR MANUFACTURING THE SAME

(75) Inventors: Xiaoming Huang, Zhuhai (CN); Yanzhou Mai, Guangzhou (CN); Qiang Fu, Guangzhou (CN); Xudong Chen, Guangzhou (CN); Zhongfeng Peng, Guangzhou (CN); Anmin Deng, Guangzhou (CN); Huiming Ge, Guangzhou (CN)

(73) Assignee: China United Network Communications Group Company Limited, Beijing (CN)

( * ) Notice: Subject to any disclaimer, the term of this patent is extended or adjusted under 35 U.S.C. 154(b) by 297 days.

(21) Appl. No.: 13/502,328

(22) PCT Filed: Oct. 15, 2010

(86) PCT No.: PCT/CN2010/001615

§ 371 (c)(1), (2), (4) Date: Jul. 9, 2012

(87) PCT Pub. No.: WO2011/044756

PCT Pub. Date: Apr. 21, 2011

(65) Prior Publication Data

US 2013/0099995 A1 Apr. 25, 2013

(30) Foreign Application Priority Data

Oct. 16, 2009 (CN) ..... 2009 1 0206813

(51) Int. Cl.

| | |
|---|---|
| ***H01Q 13/00*** | (2006.01) |
| ***H01Q 1/00*** | (2006.01) |
| ***H01P 11/00*** | (2006.01) |
| ***H01Q 9/40*** | (2006.01) |
| ***H01Q 1/42*** | (2006.01) |
| ***H01Q 13/04*** | (2006.01) |
| ***H01Q 9/28*** | (2006.01) |

(52) U.S. Cl.

CPC ..... *H01Q 1/007* (2013.01); *H01P 11/001* (2013.01); *H01Q 9/40* (2013.01); *H01Q 1/42* (2013.01); *H01Q 13/04* (2013.01); *H01Q 9/28* (2013.01)

USPC ..... 343/773

(58) Field of Classification Search

CPC ..... H01Q 1/40; H01Q 9/28

USPC ..... 343/773

See application file for complete search history.

(56) References Cited

U.S. PATENT DOCUMENTS 2,511,849 A * 6/1950 Hilferty ..... 343/773
6,667,721 B1 12/2003 Simonds (Continued)

FOREIGN PATENT DOCUMENTS

CN 2558099 Y 6/2003
CN 101694904 A 4/2010

(Continued)

*Primary Examiner* — Dieu H Duong

(74) *Attorney, Agent, or Firm* — Finnegan, Henderson, Farabow, Garrett & Dunner, L.L.P.

(57) ABSTRACT

A ceiling-mount omni-directional antenna for indoor distribution system of mobile communication network and a method for manufacturing the same are provided. The antenna includes: a monopole consisting of a cone part and a columnar part, and a reflecting plate consisting of a cone part and a platform part, and a feed connector. The monopole and the reflecting plate are arranged in such that the tips of cone parts are opposite to each other. The signal is fed into the antenna through the feed connector and radiated outward by the monopole and the reflecting plate. In high frequency band, the maximal gain appears at about 70°, so that the signal power focuses at radiating angles of 60°-85°. The gain of the antenna increases 4.22 dB at a radiating angle of 85° and decreases IOdB at a radiating angle of 30°.

16 Claims, 8 Drawing Sheets

(56) References Cited

U.S. PATENT DOCUMENTS

| | | | | |
|---|---|---|---|---|
| 2006/0022885 | A1* | 2/2006 | Ida et al. | 343/773 |
| 2009/0195470 | A1 | 8/2009 | Tsurusu et al. | |
| 2009/0237314 | A1 | 9/2009 | Lalezari | |
| 2012/0176286 | A1* | 7/2012 | Amert et al. | 343/773 |

FOREIGN PATENT DOCUMENTS

| | | | |
|---|---|---|---|
| CN | 201533018 | U | 7/2010 |
| JP | 2007-194891 | | 8/2007 |
| KR | 2003-0055659 | A | 7/2003 |

* cited by examiner

INDOOR CEILING-MOUNT OMNIDIRECTIONAL ANTENNA AND A METHOD FOR MANUFACTURING THE SAME

FIELD OF THE INVENTION

The present invention relates to a mobile communication field, and more particularly, to a ceiling-mount omnidirectional antenna for indoor distribution system of mobile communication network and a method for manufacturing the same.

BACKGROUND ART

An indoor distribution system of modern cellular mobile communication network widely employs ceiling-mount omnidirectional antennas. Amount of the ceiling-mount omnidirectional antennas accounts for more than 95% of antennas for an indoor distribution system. Technique requirements of the existing standard for ceiling-mount omnidirectional antenna includes: ranges of frequency are 806~960 MHz and 1710~2500 MHz; voltage standing wave ratio (VSWR) is <1.5; the gain is 2 dBi in low frequency band, and is 5 dBi in high frequency band.

A basic principle of a ceiling-mount omnidirectional antenna is half wavelength dipole antenna. A ceiling mount omnidirectional antenna usually consists of a monopole and a reflecting plate. The monopole may have microstrip patch of cone shape, column shape, ball shape, square shape, butterfly shape or various combinations or modifications thereof, various shapes and so on. To thicken or broaden a dipole may increase the working bandwidth; the reflecting plate is generally flat plate of circle shape, oval shape or square or flat plate with cone roof. The reflecting plate is equivalent to another arm of dipole antenna. On one hand, it forms a mirror image of monopole and reflects electric waves at the same time so as to strengthen radiation at the side of monopole. The higher the frequency, the stronger the reflection, and the closer the feed point to the reflecting plate, the stronger the reflection. On the other hand, it is convenient for a mounting on indoor ceiling and reducing a protrusive height of an antenna so as to minimize the impact on indoor circumstance. The mainstream product of conventional ceiling-mount antenna is a structure of a combination of single cone and reflecting plate, while some products with relative poor quality are a double-cone structure.

The existing ceiling-mount omnidirectional antennae are originally designed for signal indoor coverage of mobile communication wireless networks which work at low frequency band 806~960 MHz, such as GSM 900 and CDMA. At this frequency band, a ceiling-mount omnidirectional antenna is characterized as a normal symmetrical half wavelength dipole. In spherical coordinates with Z axis perpendicular to the ground when the antenna mounted on ceil as shown in FIG. 1*a* and FIG. 1*b*, the typical radiation pattern in equatorial plane (also called as a horizontal plane, H plane) being a circle; and in meridian plane (also called as a vertical plane, E plane) is a "∞" shape, the maximum gain is at the direction about θ=90°. The antenna gain is about 2 dBi. Except in the range of a small angle near Z axis direction (θ<30°), the difference of the gain with the direction variation is not obvious (less than 3 dB). In high frequency band (1710~2500 MHz), the radiation pattern in equatorial plane is a circle; whereas in meridian plane is a bilobed lung shape. It behaves directional obviously and the maximum gain being at about θ=35°, greatly different from that at low frequency band even though the antenna gain is about 5 dBi, higher than that at low frequency band (see FIG. 1*a* and FIG. 1*b*).

The strong directivity of existing ceiling-mount omnidirectional antenna at high frequency band is determined by length of the dipole and reflecting characteristics of electromagnetic wave. As for high frequency band, the equivalent length of dipole is longer than one wavelength, the main radiation lobe split in a "*" shape. In addition, for a ceiling-mount antenna, if the reflecting plate has a relative large size, the reflecting effect is stronger.

In a test of existing ceiling-mount omnidirectional antennae, the result demonstrates that, the antenna gain is stable with a slight change when the radiating angle θ>60° in low frequency band (806~960 MHz) (see FIG. 1*a*); but radiation focuses towards right under the antenna in high frequency band (1710~2500 MHz), and the maximum gain direction in meridian plane is θ≈35°, the gain attenuating about 3 dB when θ=60°, about 7 dB when θ=80°, about 8 dB when θ=85°. FIG. 1*a* and FIG. 1*b* are radiation patterns in E plane at frequency of 800 MHz and 2170 MHz respectively, which are two typical radiation patterns at higher and low frequencies, reflecting basic features of radiation patterns in higher and low frequency bands. As can be seen, the antenna gain attenuates rapidly as the radiating angle θ increases from 60° to 85°.

In high frequency band, the gain's rapid attenuation with the radiation angle increase is a crucial technical defect of the existing ceiling-mount omnidirectional antennae. It causes the energy of mobile communication wireless signals, such as DCS1800 and 3G networks, in indoor distribution system to focus right under the antenna excessively, viz. focus within the radiating angle θ less than 60°. Therefore, the signals strength attenuates rapidly with distance, the effective coverage radius is small and the coverage efficiency is low, thereby it reduces the effect of whole indoor distribution system.

Another defect of the existing ceiling-mount omnidirectional antennae are their high un-roundness of H-plane radiation pattern. As the mainstream products are small in size and impedance in low frequency is not matched. It is necessary connect a metal sheet (or line) to adjust impedance. In addition, in accordance with Standard GB T 21195-2007, directly grounding is required for lightening prevention, and the impedance matched sheet also plays the role for monopole grounding. However, the impedance matched sheet spoils axis symmetry, rendering poor uniformity with azimuth and high un-roundness of H plane radiation pattern. A kind of the existing ceiling-mount omnidirectional antennae with better quality adopts three impedance matched sheets, while most of them with poor quality only adopt a single impedance matched sheet. So the omnidirectional antennae behave as directional ones obviously because of the impedance sheet(s). In high frequency band, at a high radiating angle θ (85° typically) corresponding to an antenna's coverage edge, the un-roundness of H plane radiation pattern for three impedance matched sheets is generally 1.5~3 dB, equivalent to the difference between the maximum and the minimum gain of 3~6 dB; for a single impedance matched sheet is generally 3~6 dB, equivalent to a difference between the maximum and the minimum gain of 6~12 dB.

A real application scene is provided as follow for further explanation the problems caused by the above technical defects of the existing ceiling-mount omnidirectional antennae.

The interior floor of a common building has a height of about 3 m. No matter whether a mobile user stands or sits at a desk, a mobile communication terminal is usually above shoulders, so the height of mobile communication terminal off the floor is generally higher than 1 meter, and the height between indoor ceiling-mount antenna and mobile communication terminal is less than 2 meters. In indoor distribution system design principle, an antenna coverage radius is: less than 10 m for dense and important building, about 15 m for common building or 20 m for open region. As can be seen by calculation, the radiating angle θ to the above antenna coverage edge is 79°, 82° or 84° respectively. So 85° can be the typical radiating angle to antenna coverage edge. In accordance with FIG. 1*a* and FIG. 1*b*, at this angle, the gain of the existing ceiling-mount omnidirectional antenna attenuates 7~8 dB. If the maximum gain 5 dBi, the antenna gains at these angles are only −2~−3 dBi. But in the region of radiating angle θ≤60°, the gain is relatively high (less than 3 dB attenuation), and the coverage radius is less than 3.5 m.

It can be concluded that the existing ceiling-mount omnidirectional antenna causes DCS1800 and 3G signals to mainly focus within a range of 3.5 m coverage radius, and the large portion of the designed coverage region, radius from 3.5 m to the edge, the antenna gain attenuates up to 7~8 dB, together with path loss increasing by frequency and distance. The coverage radiuses of DCS18000 and 3G signals are much smaller than that of GSM 800 MHz, so all these signals coverage cannot be synchronous.

In order to obtain a better indoor signal coverage, it just can raise antenna input power or increase density of antenna layout. But the antenna input power is limited by meeting hygienic standard for environmental electromagnetic waves and the minimum coupling loss (MCL) (In 3G networks, the input CPICH power to the existing ceiling-mount omnidirectional antenna should be less than 5 dBm). Therefore, "low power, abundant antennas" as 3G indoor distribution system design principle is generally adopted, and a scale of indoor distribution system construction and reconstruction are multiplied, thereby bringing about the enormous investment for 3G indoor distribution system construction and reconstruction.

High un-roundness of existing ceiling-mount omnidirectional antennae renders the signal covering not uniform and stable. On the same radius circle, strengths of signals change with azimuth, showing obviously directional. Through the above calculation, on the coverage edge, the difference of signal strength is 2~4 times for a single impedance matched sheet antenna, while 4~more than 10 times for 3 impedance matched sheets antenna, rendering the signal coverage deficient in some places and yet excessive in some other places, which reduces network quality.

Besides that, as 2G and 3G signals cover asynchronously, adding more antennas to satisfy 3G signal covering causes 2G signal too strong and power waste and results in more serious signal outdoor leakage, reducing 2G network quality and efficiency. The increase of antennas also brings about more power distribution loss, which wasting more signal power.

Therefore, a principle of "low power, abundant antennas" is forced to be adopted due to the uneven indoor distribution of 3G signal. Moreover, the purpose of this principle is to obtain a quality of 3G network at the expense of increasing investment cost and sacrificing 2G network qualities.

In an indoor distribution system, the more uniform the signal distribution within the target covering region, the better, while the weaker the signals outside the target region, the better. But point source of electromagnetic wave radiates over spherical surface. In a free space, signal energy reduces according to square of propagation distance, that is, 6 dB losses for double range. There is the strongest signal strength under antenna, and the closer to the antenna, the quicker the signal strength attenuates, while the farther the signal away from the antenna, the slower the signal strength attenuates. So, the signal coverage of an indoor ceiling-mount omnidirectional antenna mainly focuses on factors such as the maximum permitted input power, the minimum signal strength at coverage edge, uniformity and stability of signal within coverage and so on.

SUMMARY OF INVENTION

In order to solve the above technical problems, considering practical factors of an omnidirectional antenna in indoor distribution system, the present invention provides a ceiling-mount omnidirectional antenna for indoor distribution system of mobile communication network and the method for manufacturing it. One of objects of the present invention is to increase the gain of the antenna at high radiating angle, and the maximal gain radiating angle increases to more than 70°, and the gain at 85° radiating angle achieves 2~3 dB, thereby increasing signal strength at the region relatively far away from the antennas of the target coverage and alleviating signal pass loss which makes signal distribution more uniform and enlarges the effective coverage radius.

A second object of the present invention is to reduce the gain at low radiating angle in high frequency band, to reduce radiation just under antennas and increase the maximal permitted input power value of the antenna.

A third object of the present invention is to reduce un-roundness of H plane radiation pattern. The un-roundness index in whole frequency bands can be controlled within 1 dB. As such, signal distribution is more uniform and stable, and the coverage range can be easily controlled.

In order to achieve the above invention objects, the present invention discloses a ceiling-mount omnidirectional antenna, the antenna comprising:

a monopole having a conical-column structure, the monopole includes a first cone part and a columnar part, the first cone part has a first small base and a first large base;

a reflecting plate having disc-cone structure and arranged below the monopole, the reflecting plate includes a second cone part and a disc, the second cone part has a second small base and a second large base; and a feed connector disposed in a center of the second small base of the second cone and connecting with a feed coaxial line, for receiving and sending signal feed-in and feed-out.

The monopole and the reflecting plate are arranged such that the first small base of the first cone part faces the second small base of the second cone part.

The present invention also discloses a method for manufacturing an indoor ceiling-mount omnidirectional antenna, the method comprising:

disposing a monopole having a conical-column structure, the monopole includes a first cone part and a columnar part, the first cone part has a first small base and a first large base;

disposing a reflecting plate having disc-cone structure and arranged below the monopole, the reflecting plate includes a second cone part and a disc, the second cone part has a second small base and a second large base;

disposing a feed connector in a center of the second small base of the second cone part and connecting with a feed coaxial line, for receiving and emitting signal feed-in or feed-out.

The monopole and the reflecting plate are arranged such that the first small base of the first cone part faces the second small base of the second cone part.

The technical effects of the present invention are as follows:

1. The gain in high frequency band increases at a high radiating angle. The radiating angle of the maximal gain is increased to more than 70°. The gain increases by 2~3 dB at a radiating angle of 85°. Compared with the existing ceiling-mount omnidirectional antenna, in high frequency band, the gain of the antenna increases by 3~6 dB within range of radiating angles of 60°~85°, thereby increasing the signal strength in the region relatively far away from the antenna within the target coverage and alleviating the signal path loss to make signal distribution more uniform. The gain increases by 4.22 dB at a radiating angle 85° on average, particularly, the increasing of signal field strength at coverage edge in 3G frequency band and the signal field strength at the edge is increased by 4.69~6.59 dB. As a result, the signal coverage is more uniform and the effective coverage area is enlarged by more than three times. Thus, a design principle "low power, abundant antennas" for 3G indoor distribution system is changed, that is, the number of antennas is reduced in multiplication, indoor distribution system is streamlined and the investment and the difficulty for construction is reduced. Taking all scenarios of indoor distribution system construction into consideration, the investment saved by the indoor ceiling-mount omnidirectional antenna of present invention is more than 30%.

2. The gain in high frequency band decreases at a low radiating angle and the gain actually measured is less than −5 dB within a radiating angle of 30°. Comparing with the existing ceiling-mount antenna, the gain decreases by more than 10 dB at a radiating angle being less than 30° and the strongest radiation decreases by more than 9 dB.

3. An un-roundness index of the antenna decreases and the un-roundness in full frequency bands can be controlled within 1 dB. As a result, the signal distribution is more uniform and stable and the coverage range can be controlled more easily. Compared with the existing ceiling-mount omnidirectional antenna, in high frequency band, the un-roundness index decreases by about 1.5 dB at a radiating angle of 85°, equivalent to that the signal strength difference of the signal coverage edge is reduced by 3 dB.

4. Promote efficiency, save energy and protect environment. Compared with conventional antenna, the indoor ceiling-mount omnidirectional antenna of the present invention focuses 3G signal power within radiating angles of 60~85° and the gain increases by 4.69~6.59 dB at a radiating angle of 85°. As a result, efficiency of the signal source is increased by 2.94~4.56 times, source equipments and their affiliated equipments are decreased and energy consumption is reduced. Meanwhile, as for signal in high frequency band, the strength of the signal decreases by more than 10 dB within 30° radiating angle, which weakens electromagnetic radiation under the antenna and effectively alleviates the problem of electromagnetic radiation under the antenna.

5. Realize 2G and 3G networks signal coverage synchronously. As the indoor ceiling-mount omnidirectional antenna of the present invention enlarges the covering range of signal in high frequency band, combined with that the maximal permissible input power increases by 9 dB, the maximal input CPICH power of 3G signal can reach 14 dBm. Therefore, antenna input power can be designed flexibly and coverage radius can be designed properly, which makes the coverage of a single antenna for different communication systems and different edge signal strength requirement stay in consistency with each other. As a result, the thorny issue of asynchronous coverage of 2G and 3G networks can be solved, which makes the reconstruction for 3G indoor distribution more easily just replacing the existing ceiling-mount omnidirectional antennas by that of present invention. It provides technical supports for commonly sharing indoor distribution antenna system by combining multi communication system signals into indoor distribution system, and for joining forces to construction and sharing the communication infrastructures of indoor distribution system by telecommunication operators in order to avoid wasting of repeating construction and to raise utilization rate of communication infrastructural resources.

The antenna structure of the present invention is simple. The grounding or the impedance matched sheet(s) of the conventional antenna is cancelled in the antenna structure of the invention so there is no requirement of impedance adjustment. The antenna is easy to be assembled and good consistency, which are beneficial for mass-production and product quality control.

BEST EMBODIMENTS FOR REALIZING THE PRESENT INVENTION

With the attached diagrams, a detailed description for the present invention as following.

On the defects of existing ceiling omnidirectional antennas that focusing signal within small radiating angle in signal in high frequency band excessively and unevenly signal distribution, and give consideration of uniformity of the gain and the direction in high and low frequency bands, a high performance ceiling-mount omnidirectional antenna for indoor distribution system is designed that ensures performance in low frequency band and to improve it in high frequency band. Specifically, the gain in high frequency band decreases at a low radiating angle and increases at a high radiating angle. Meanwhile, considering that grounding and lightening protection of dipole for indoor antenna have little practical significance, in order to improve the un-roundness, the lightening protection and grounding sheet(s) is cancelled and the volume of the antenna is reasonably enlarged. By exact designing, the impedance of the antenna in full frequency bands is matched with feeder cable of 50Ω characteristic impedance, and voltage standing wave ratio is controlled within 1.5.

Firstly, radiation pattern should be taken into consideration.

Changing the radiation pattern like that of the existing ceiling-mount omnidirectional antenna in high frequency band, by decreasing the gain at low radiating angle and increasing the gain at a high radiating angle, is an effective method to increase antenna coverage. The "omnidirectional" antenna refers to uniform radiations in all azimuths, by no means at radiating angles in different directions. The high gain at low radiating angle means strong radiation under the antenna, which is harmful; whereas the high gain at a high radiating angle means strong signal at the coverage edge, which is beneficial. As for indoor distribution system, the purpose of the antenna is to make signal cover the target region effectively and evenly. Therefore, the gain of the ceiling-mount omnidirectional antenna needs to be decreased at low radiating angle and increased at high radiating angle as much as possible. But the radiating angle of 90° means that the signal radiates horizontally. So the gain at a radiating angle of 85° corresponding to the coverage edge should be increased as much as possible, but the gain close to the radiating angle of 90° should be suppressed.

The present invention fulfills the purpose of controlling the gains of the antennas at different radiating angles by changing structure and size of the antenna.

Secondly, antenna structure should be taken into consideration.

According to features of the omnidirectional antenna, in high frequency band, the present invention adopts a prototype of biconical antenna in order to increase the radiating angle of maximal gain.

Figure 1:
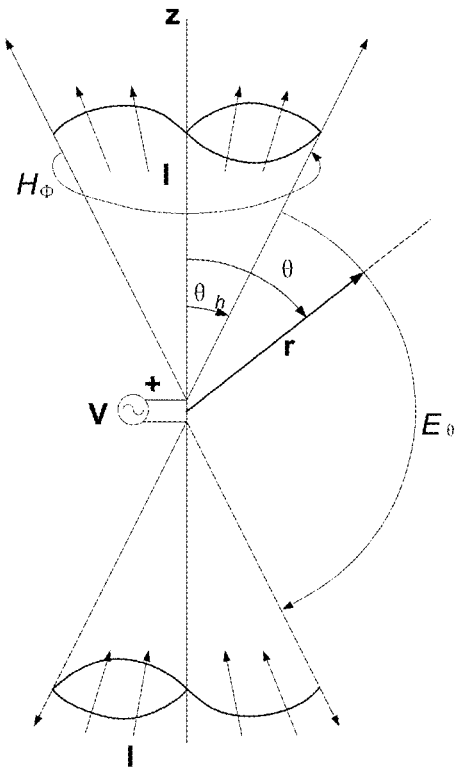
FIG. 1 is a radiation pattern for symmetrical biconical antenna with an infinite length.
Figure 1A:
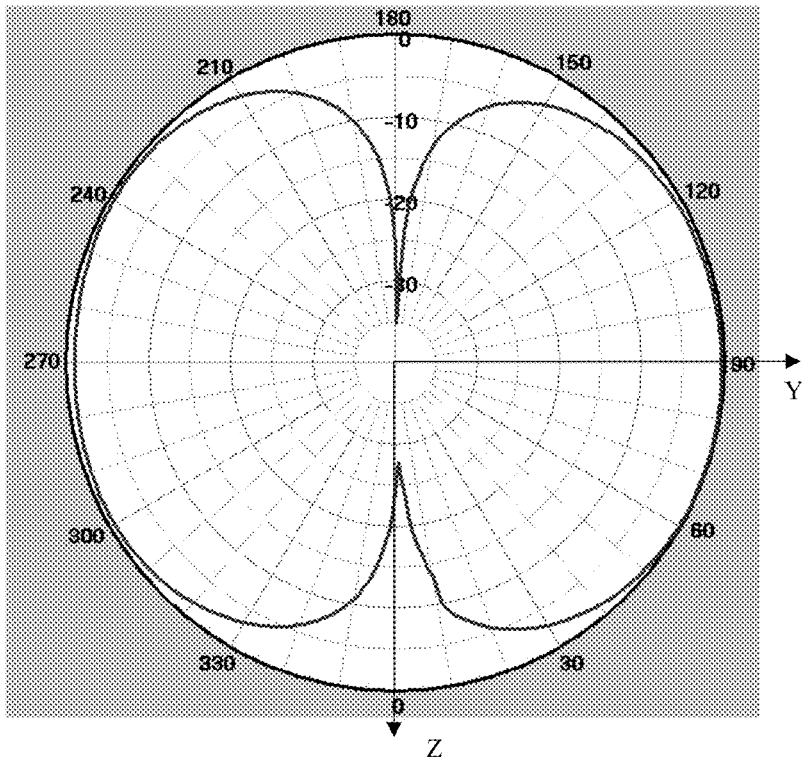
FIG. 1*a* is the measured radiation pattern of existing antenna in E plane at the frequency of 800 MHz.
Figure 1B:
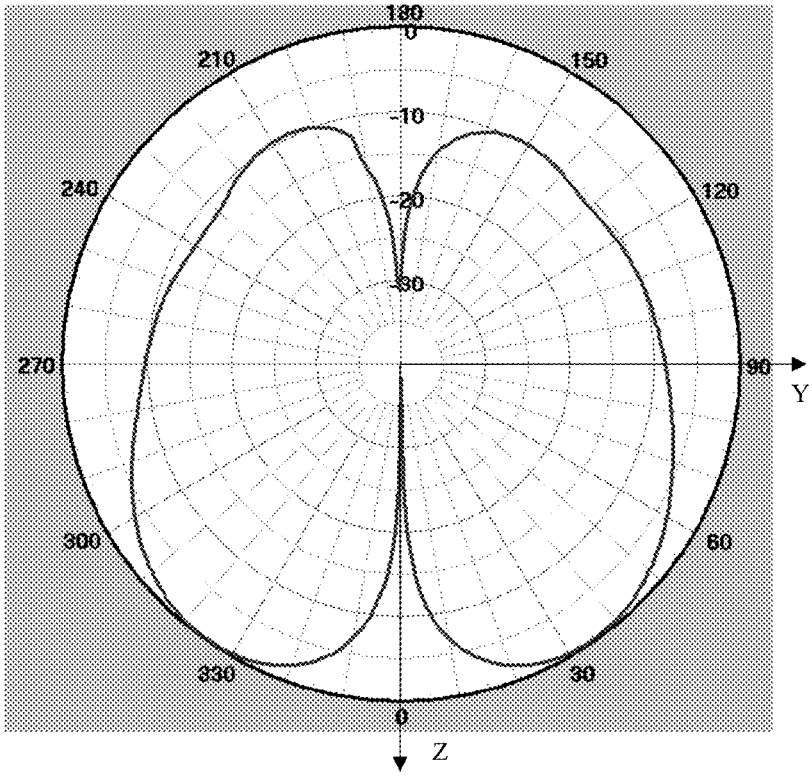
FIG. 1*b* is the measured radiation pattern of existing antenna in E plane at the frequency of 2170 MHz.

As for a symmetrical biconical antenna with infinite length, see FIG. 1, Expressions for electromagnetic field can be obtained by Maxwell equations:

$$H_\phi = H_0 \frac{1}{4\pi r \sin\theta} e^{-j\beta r}$$

$$E_\theta = \eta H_0 \frac{1}{4\pi r \sin\theta} e^{-j\beta r}$$

Normalization function of radiation pattern as:

$$F(\theta) = \frac{\sin\theta_h}{\sin\theta}, \theta_k < \theta < \pi - \theta_h$$

Input impedance as:

$$Z_A = 120 \ln\left(\cot\frac{\theta_h}{2}\right) \quad (\Omega)$$

wherein, $H_0$ is amplitude of magnetic field

θh is a cone angle of the antenna $\beta = 2\pi f\sqrt{\mu\epsilon}$, $\eta = \sqrt{\mu/\epsilon}$ In a free space, $\eta_0 = \sqrt{\mu_0/\epsilon_0} = 120\pi$ As can be seen from the above Formula, the function F(θ) and the input impedance $Z_A$ of infinite biconical antenna are relevant only to the cone angle $\theta_h$ of the antenna, not to frequency. So, it is a frequency-independent antenna.

Particularly, $Z_A$ is equal to 100Ω when θh is equal to 46.98°; $Z_A$ is equal to 50Ω when θh is equal to 66.79°.

If one of cones unfolds to a plane, it is an infinite dis-conical antenna, the input impedance is a half of that of biconical antenna. Therefore, $\theta_h$=46.98° corresponds to 50Ω input impedance of infinite dis-conical antenna.

Intercepting an infinite biconical antenna is a finite biconical antenna. As for the rapid attenuation of surface emitting current on antenna surface with distance increase from feed point, the range of a first wavelength is the main radiation region of the antenna. Therefore, a certain length finite biconical antenna can maintain a relative broad frequency band, that is a broadband antenna.

In low frequency band, the present invention still adopts a basic principle of a dipole. So the antenna structure of the present invention is a combination of a biconical antenna and a dipole antenna. As for a high frequency signal, it is a biconical antenna, while as for a low frequency signal, it is a half wave dipole.

Thirdly, the antenna frequency bandwidth and volume should be taken into consideration.

As a broadband antenna, its volume determines a bandwidth and Q value. Therefore, the size of an antenna with a determined frequency bandwidth cannot be made too small. This is Chu-Harrington limitation, and this is also the reason why the existing ceiling-mount omnidirectional antenna must have impedance match sheet(s) to match impedance in low frequency band. Considering the needs of communication network development and evolution, it is worthwhile to enlarge volume reasonably for obtaining more stable broadband performance.

The present invention reasonably enlarges the size of the antenna based on obtaining more stable performance in the bandwidth. By exacting designing, the impedance matched sheet(s) is cancelled, so the antenna is rotational symmetry completely, this improves the un-roundness a lot.

Fourthly, the lightening protection consideration

In accordance with National Standard of The People's Republic of China GB/T21195-2007 <<The Specifications Of Antenna For Mobile communication Indoor Distribution System>>, the ceiling-mount omnidirectional antenna for indoor distribution system is required for grounding directly, this is interpreted that the radiation dipole is grounded directly. The purpose of grounding is to prevent the strong current pulse on monopole generated or induced by lightening may flow back into communication equipment room through the core of feeder cable such as a machinery room, which poses a threat to the equipments such as base station. But as the ceiling-mount omnidirectional antenna is indoor mounted, the buildings generally have relatively good measures for lightening evading and preventing, the antenna dipole being attacked by the lightening directly or inducing a strong lightening pulse is almost impossible. Therefore, the dipole grounding has little practical significance. If the indoor distribution system is huge and there is a span-buildings cable or some antennas laying outside, adding lightening evading apparatus can also achieve the object of evading lightening before the antenna feeder cable enters the communication equipment room if grounding is necessary.

Indoor antenna grounding requirement in the National Standard may a result of simply imitating the requirements for outdoor antenna, whereas there is no such requirement for indoor antennas in other countries.

In accordance with the actual situation, the present invention increases a stable performance of signal coverage and cancels the grounding for evading lightening, which is also for improving un-roundness of the antenna.

In accordance with the above ideas of designing and manufacturing, the present invention adopts a unique structure that combines a biconical antenna and a half-wave dipole. As for high frequency signal, the antenna disclosed in the invention is equivalent to a biconical antenna, while as for a low frequency signal, the antenna disclosed in the invention is a half-wave dipole with a monopole of conical-column structure. A dipole is a structure of a monopole of a cone combined with a column, and a reflecting plate of a circle plate combined with a cone. The cone parts of the monopole and the reflecting plate serves as a biconical antenna in high frequency band, and the whole monopole and the reflecting plate serves as the antenna of a half-wave dipole in low frequency band. Meanwhile, a cone of the reflecting plate raises the position of the feed point and weakens reflection so as to increase the radiating angle of the maximal gain of high frequency signal. Adjusting angles and scales of the cones of the reflecting plate and the monopole makes a direction of the maximal gain of all frequencies in high frequency band at about 70°, focusing main radiation powers in high frequency band within the radiating angles of 60~85°.

Through computer simulation, a scale and size of the antenna are adjusted and optimized step by step to obtain a relative ideal antenna model of the present invention. Based on this, the antenna product of the present invention can be manufactured by perfecting and improving process and determining qualified material for manufacturing. Through repeated tests and verification by actual application, the antenna performance of the present invention is stable and superior.

The present invention discloses a method for manufacturing an ceiling-mount omnidirectional antenna, comprising the following steps:

(1) disposing a monopole having a conical-column structure, wherein the cone part of said conical-column structure is one arm of a biconical antenna dipole in high frequency band and also serves as one arm of a half-wave dipole in low frequency band with the columnar part;

(2) disposing a reflecting plate having disc-cone structure, wherein the cone part of the disc cone structure is another arm of the biconical antenna dipole in high frequency band and also serves as a ground reflecting plate of the half-wave dipole together with the disc at the same time;

(3) disposing said reflecting plate and said monopole in such that the tops of both cone parts are face to face, forming an opposite structure of double-cone, said double-cone part serves as the biconical antenna in high frequency band, the reflecting plate having disc-cone structure and the monopole having a conical-column structure as a whole forming the half-wave dipole antenna in low frequency band;

(4) disposing a feed connector in the middle of said opposite structure of double-cone, the connector is in the middle of the reflecting plate and making it connected with 50Ω input impedance feeder cable under the reflecting plate, for receiving and emitting signal feed-in or feed-out;

(5) auxiliary components necessary for the above antenna such as plastic radome and bottom plate, connector are added. The antenna radome secures and supports the monopole and the reflecting plate, and the bottom plate may be used to secure the antenna fixed on the indoor ceil.

Adjusting a size and scale of the cone angle of said conical-column structure and said disc cone structure can adjust the radiating angle of the maximal gain of the antenna in high frequency band for the purpose of decreasing the gain at the low radiating angle and increasing the gain at the high radiating angle so as to ensure that main radiating power of the high frequency signal focuses within a range of 60~85°.

A size and scale of said monopole and reflecting plate are adjusted to ensure that input impedances in the full frequency bands match and the voltage standing wave ratio is controlled to be smaller than 1.5.

The maximal gain of the antenna in high frequency band appears at about a radiating angle of 70°. So the gain at a radiating angle of 85° should be increased as much as possible to make the coverage of a single antenna basically stay in consistency in full frequency band.

Figure 2A:
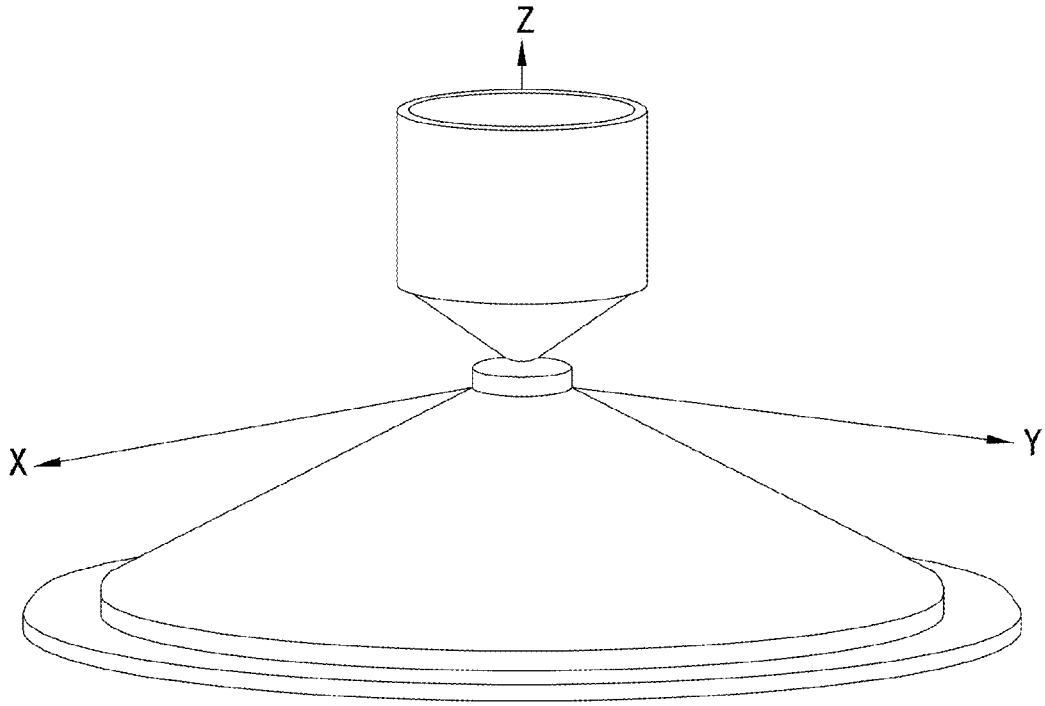
FIG. 2*a* is the diagram of ceiling-mount omnidirectional antenna provided by this present invention.
Figure 2B:
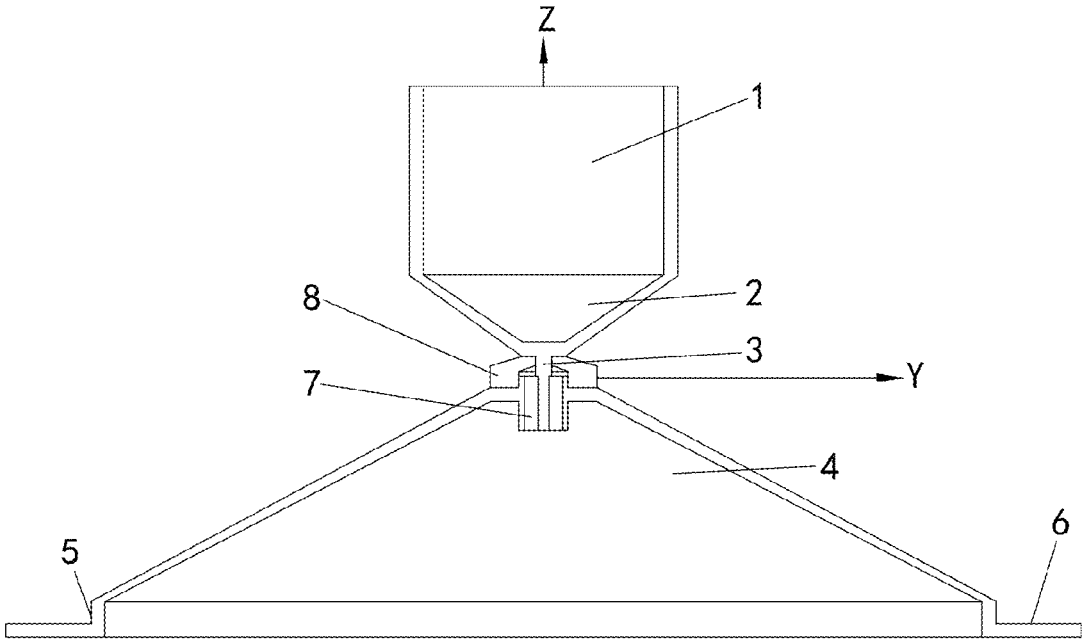
FIG. 2*b* is the cross-section of a ceiling-mount omnidirectional antenna provided by this present invention.

According to the above analysis, a ceiling-mount omnidirectional antenna provided by the present invention is shown in FIG. 2*a*, wherein FIG. 2*b* is a cross-sectional view of it and the main components relevant to the antenna emitting that manufactured by good conducting metal materials such as copper and aluminum, comprising:

a monopole: having a conical-column structure, comprising a piece of a hollow column 1, a hollow platform cone 2 and a piece of a feed column 3. A total length of the conical-column is ¼ wave length of low frequency 800 MHz (reference size: 93.75 mm), multiplying a coefficient of contraction (value range: 0.41.0, reference value: 0.6). The value range of the height of the hollow column 1: 20~55 mm (reference value: 35 mm), the value range of radius: 15~55 mm (reference value: 25 mm); the value range of the height of the hollow platform cone 2: 10~25 mm (reference value: 15 mm); the radius of the upper base is the same as that of the hollow column 1, the value range of a radius of the lower base: 2~10 mm (reference value: 4 mm); the height of the feed column 3 is 2~8 mm (reference value: 4 mm) and its radius is 1~3 mm (reference value: 1.5 mm)

a reflecting plate having a disc-cone structure, comprising a circle plate 6, a piece of a hollow column 5 and a hollow platform cone 4, the radius of the circle plate 6 being larger than 80 mm (reference size 100 mm), there is a round hole in the center of the circle plate and the radius of the hole is the same as the inner radius of a hollow column 5; the height of the hollow column 5 being 2~40 mm (reference size 4 mm) and its radius being larger than 70 mm (reference size 84 mm); the height of the hollow platform cone being 10~60 mm (reference value 44 mm), the radius of the upper base being 4~20 mm (reference value 10 mm) and the radius of the lower base being the same as a radius of a hollow column.

the structures of feed and others: using a 50Ω impedance coaxial cable and a feed connector 7 to connect to signal source, a core wire of a feed connector being connected to the feed column 3. A round hole is opened in the center of the reflecting plate, the radius of the round hole being 4~8 mm (reference size being 3.5 mm), the feed connector being mounted therein, an outer layer being secured and connected with the platform cone of the reflecting plate. Insulating materials such as polyvinyl chloride are used to fill between the outer layer and the core wire of the feed connector 7. The feed connector 7 is an existing standard connector. The thickness of the above all components is 0.5~4 mm (reference value: 1.5 mm)

In conclusion, the present invention provides a ceiling-mount omnidirectional antenna, comprising:

a monopole having a conical-column structure, wherein the cone part of said conical-column structure is a part of biconical antenna in high frequency band and also serves as a half-wave dipole in low frequency band with the columnar part;

a reflecting plate having disc-cone structure, said reflecting plate and said monopole being disposed in such that the cone parts are top to top, forming an opposite structure of double-cone, said double-cone part serves as the biconical antenna in high frequency band, the reflecting plate having disc-cone structure and the monopole having conical-column structure as a whole forming the half-wave dipole antenna in low frequency band;

disposing a feed connector in the middle of said opposite structure of double cone, the connector is in the middle of the reflecting plate and making it connected with 50Ω impedance feeder cable, for receiving and emitting signal feed-in or feed-out.

Said conical-column structure comprises a first hollow column, a first hollow platform cone and a feed column; the outer radius of the first hollow column is the same as the radius of the upper base of the first hollow platform cone, and after the first hollow platform cone and the first hollow column are connected, the lower base of the first hollow platform cone and the feed column are connected.

Said disc-cone structure comprises a circle plate, a second hollow column and a second hollow platform cone; the hole radius of a circle plate is the same as the inner radius of a second hollow column, an outer radius of a second hollow column is the same as the radius of a lower base of the second hollow platform cone. The three are connected with each other in turn.

Said double-cone structure is disposed by arranging the first hollow platform cone of the conical-column structure over the platform of the cone of the second hollow platform cone of said conical-column structure.

The cone angle and scale of said first hollow platform cone of and the second hollow platform cone said double-cone structure, can adjust radiating angle of the maximal gain for the purpose of decreasing the gain at a low radiating angle and increasing the gain at a high radiating angle in high frequency band, so as to ensure the main radiating power of the high frequency signal to focus in a range of 60~85°.

Sizes and scales of said monopole and said reflecting plate ensure impedances matched and control a voltage standing wave ratio below 1.5 in full frequency bands.

The maximal gain of the antenna of in said high frequency band appears at about a radiating angle of 70°. So the gain at a radiating angle of 85° should be increased as much as possible, so as to make a coverage of a single antenna basically stay in consistency in full frequency band.

A total length of said monopole is equivalent to a quarter of a wavelength of 800 MHz electromagnetic wave multiplying a coefficient of contraction.

A quarter of a wavelength of 800 MHz electromagnetic wave is: 93.75 mm, a value range of a coefficient of contraction: 0.4-1.0.

A feed coaxial line is a 50Ω impedance coaxial line (the size of some components of the antenna can also be adjusted properly according to different impedance of connected feed coaxial line), and a core wire of a feed connector is connected with the feed column. A round hole is opened in the center of the reflecting plate, the feed connector is mounted therein and the outer layer is secured and connected with the reflecting plate.

The radome of antenna of the present invention takes into consideration of good appearance and low electromagnetic penetrating loss materials such as plastic and fiber reinforced plastics. The radome of the antenna also secures and supports the antenna dipole and the reflecting plate. The antenna of the present invention also comprises necessary auxiliary components such as the bottom plate and the connector etc.

The platform cones of the monopole and the reflecting plate of the omnidirectional antenna are disposed opposite to each other, and there is a gasket 8 of insulating material such as ceramics and polyvinyl chloride between them to make the monopole of the conical-column secure.

In accordance with the above reference size, the results of the present invention through Ansoft HFSS simulation are provided as follows:

In FIGS. 3, 4, 5, 6, θ=0° is the direction of the antenna being perpendicular to the ground.

Figure 3:
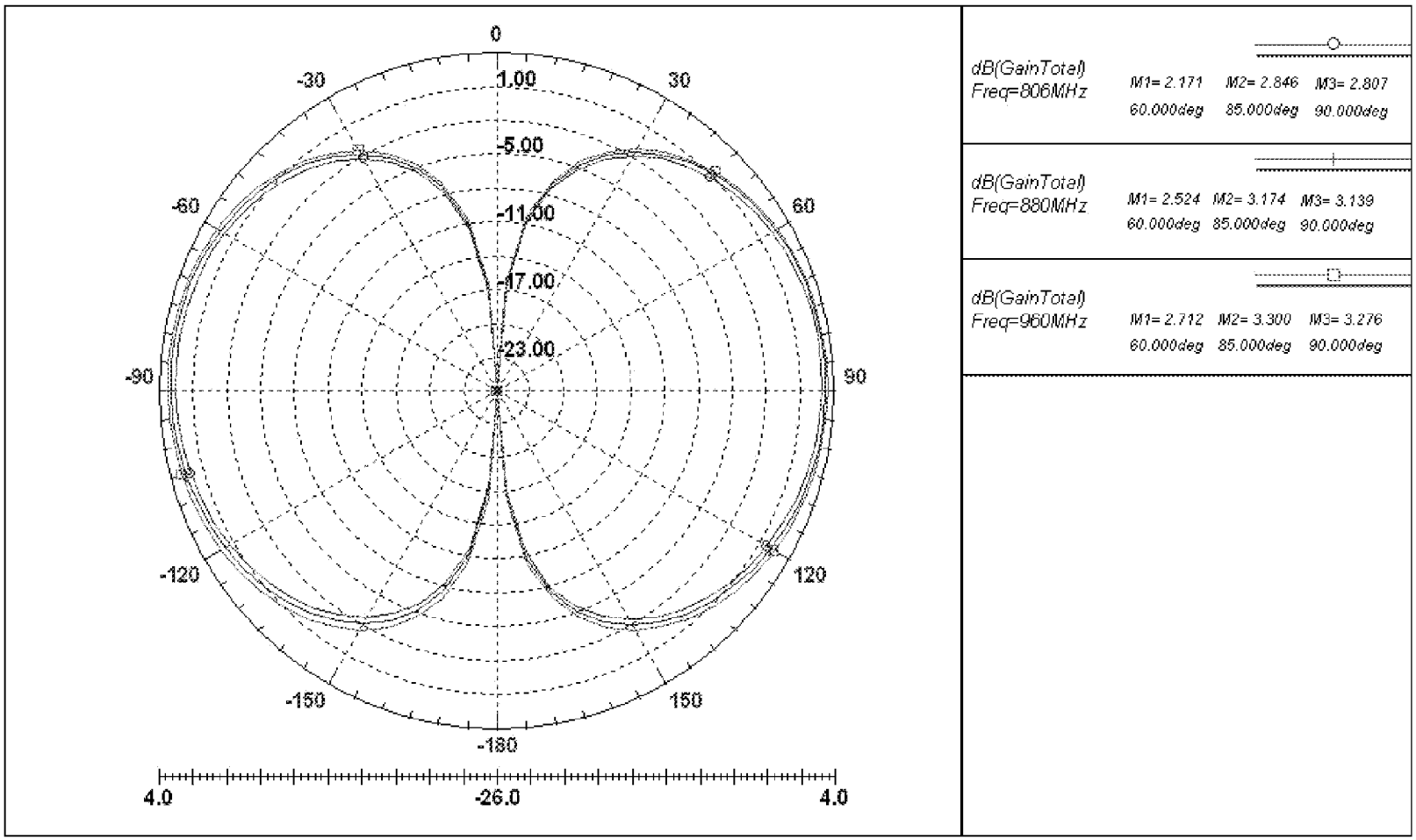
FIG. 3 are the simulated radiation patterns in meridian plane of the antenna of this present invention at frequencies of 806, 880 and 960 MHz in low frequency band.

FIG. 3 is the radiation patterns in meridian plane in low frequency band (GSM and CDMA frequency band), at 806 MHz frequency point, the maximal gain being 2.85 dBi, direction being θ=85°. At θ=60°, the gain is 2.17 dBi.

At 880 MHz frequency point, the maximal gain being 3.17 dBi, direction being θ=85°. At θ=60°, the gain is 2.52 dBi. At 960 MHz frequency point, the maximal gain being 3.30 dBi, direction being θ=85°. At θ=60°, the gain is 2.71 dBi.

Figure 4:
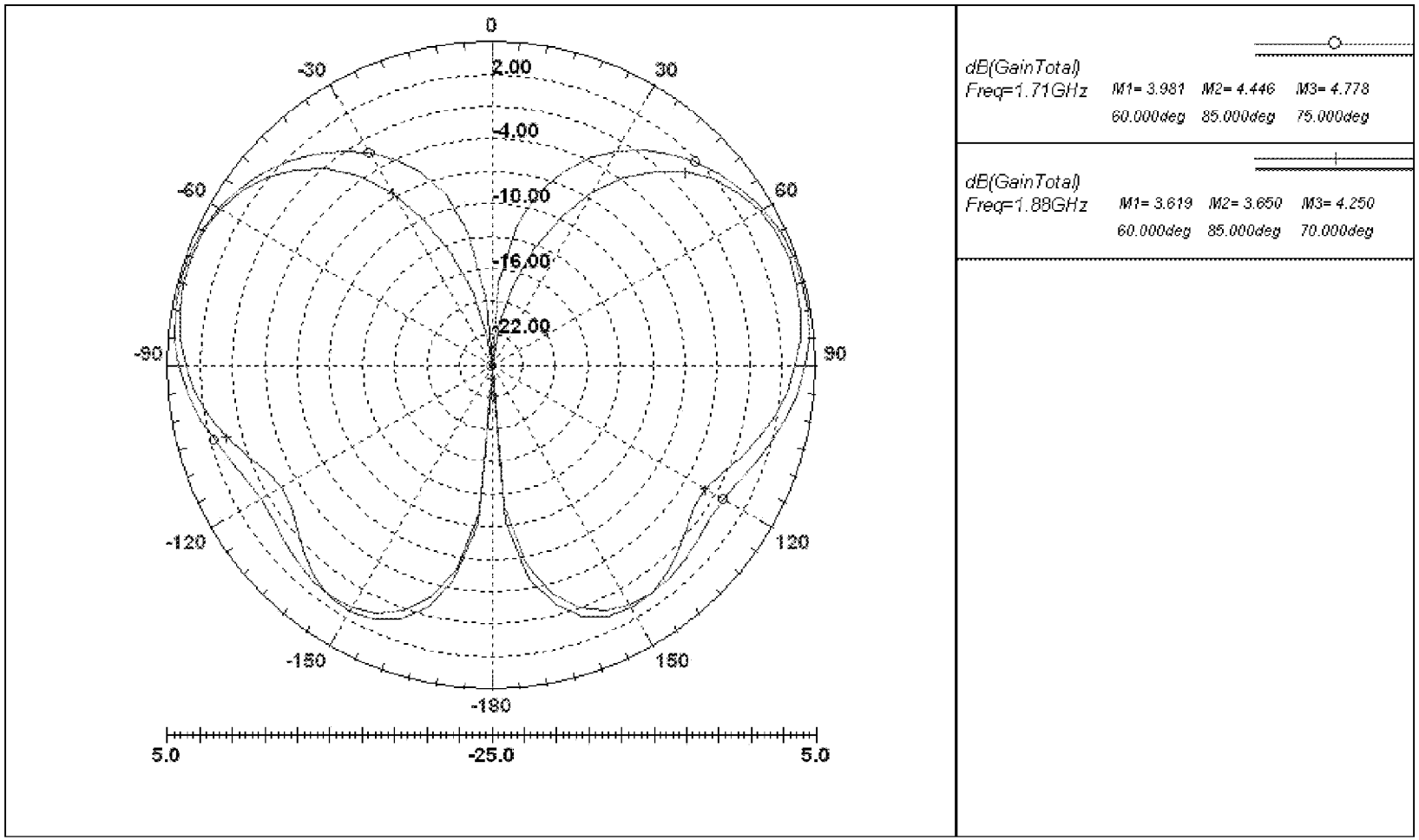
FIG. 4 are the simulated radiation patterns in meridian plane of the antenna of this present invention at frequencies of 1710 and 1880 MHZ in 1800 MHz frequency band.

FIG. 4 is a radiation pattern in a meridian plane in 1800 MHz frequency band (DCS1800 frequency band), at 1710 MHz frequency point, the maximal gain being 4.78 dBi, direction being θ=75°. At θ=60°, the gain is 2.17 dBi and the gain is 4.78 dBi at θ=85°.

At 1880 MHz frequency point, the maximal gain being 4.25 dBi, direction being θ=70°. At θ=60°, the gain is 3.62 dBi. At θ=85°, the gain is 3.65 dBi.

Figure 5:
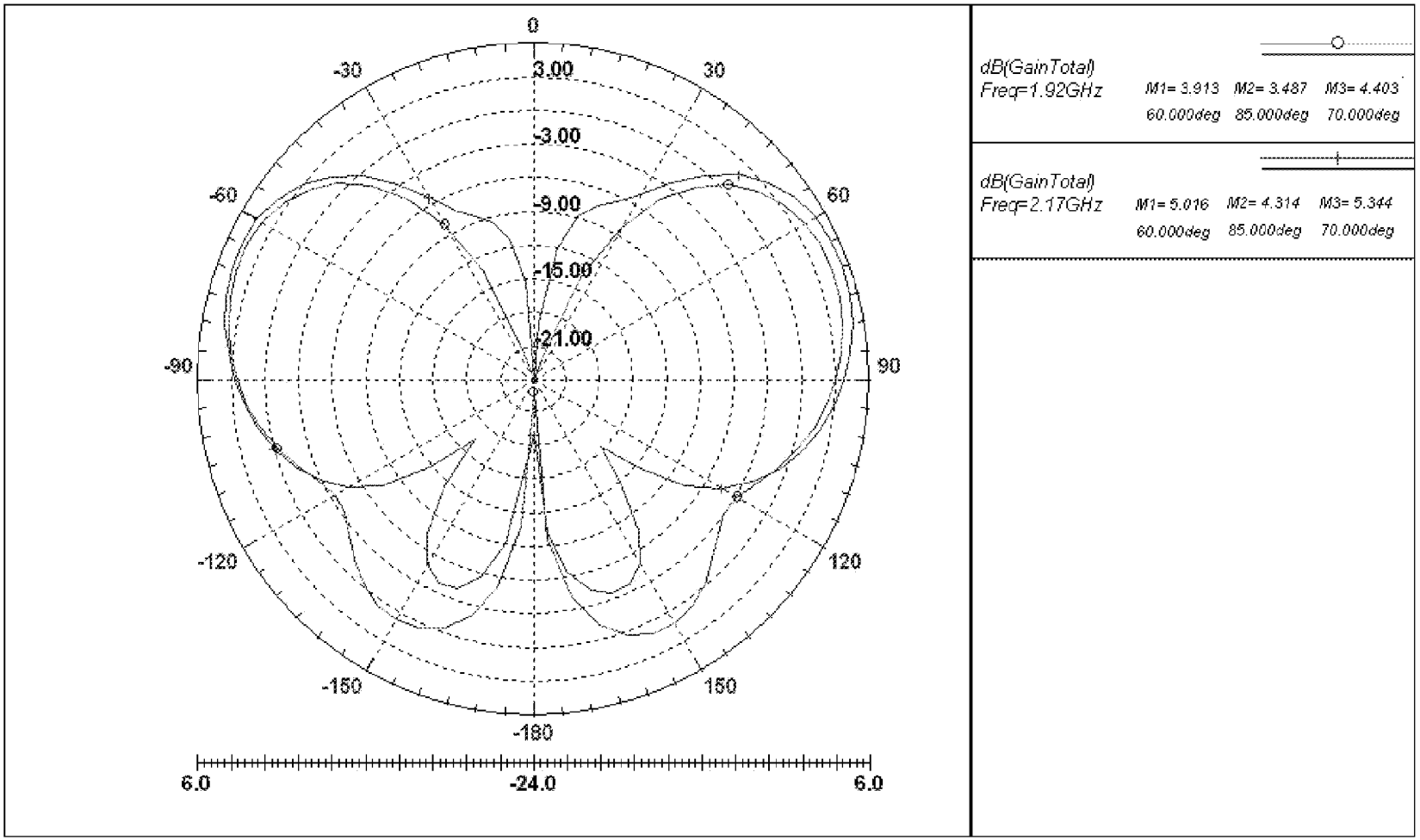
FIG. 5 are the simulated radiation patterns in meridian plane of the antenna of this present invention at frequencies of 1920 and 2170 MHz in 2000 MHz frequency band.
Figure 6:
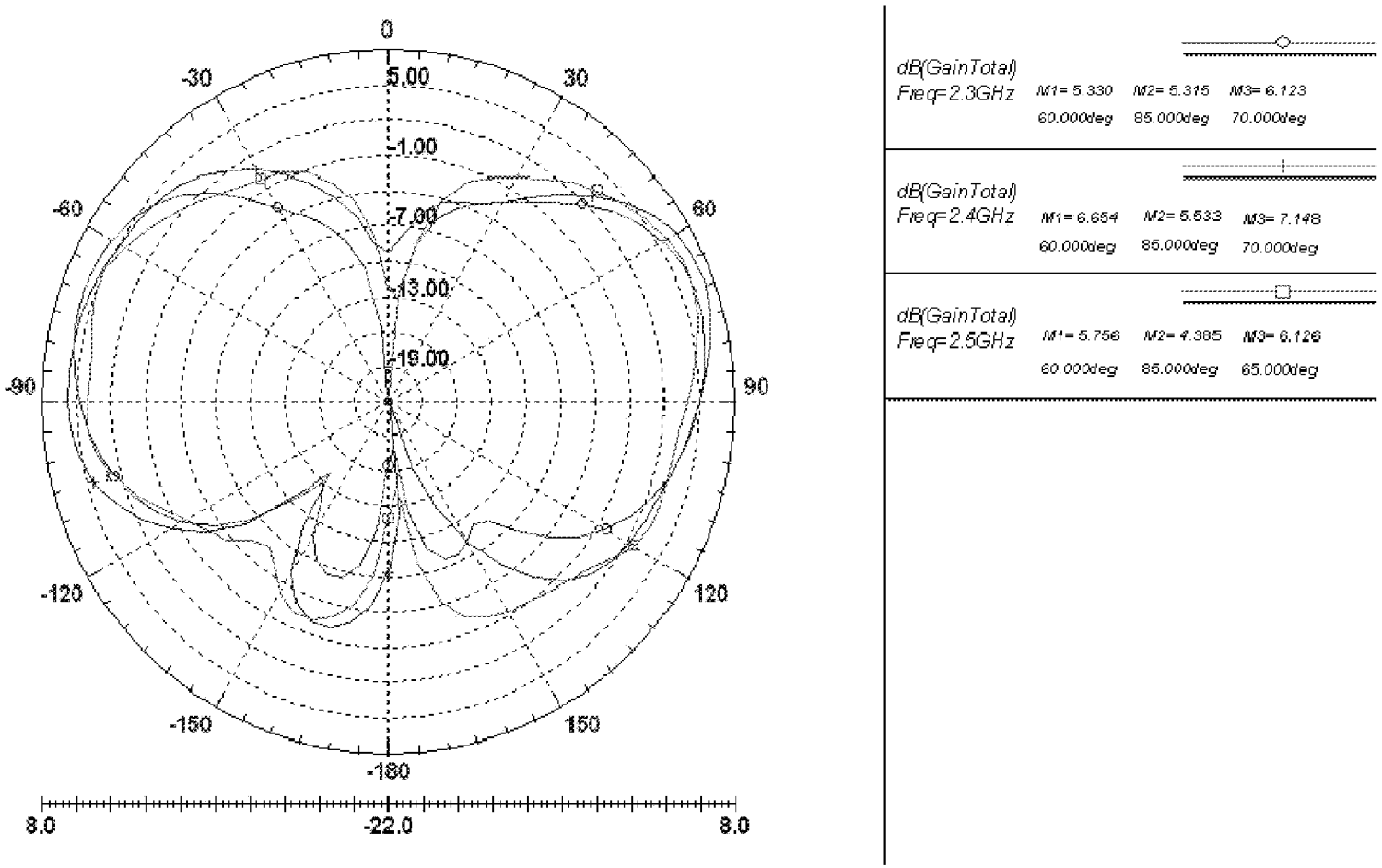
FIG. 6 are the simulated radiation patterns in meridian plane of the antenna of this present invention at frequencies of 2300, 2400 and 2500 MHz in above 2000 MHz.

FIG. 5 and FIG. 6 are the radiation patterns in meridian plane in 2000 MHz frequency band (3G frequency band)

As shown in FIG. 5, at 1920 MHz frequency point, the maximal gain being 4.40 dBi, θ=70°. At θ=60°, the gain is 3.91 dBi. At θ=85°, the gain is 3.49 dBi.

At 2170 MHz frequency point, the maximal gain being 5.34 dBi, θ=70°. At θ=60°, the gain is 5.02 dBi. At θ=85°, the gain is 4.31 dBi.

FIG. 6 is the radiation patterns in meridian plane at 2300 MHz, 2400 MHz and 2500 MHz.

At 2300 MHz frequency point, the maximal gain being 6.12 dBi, θ=70°. At θ=60°, the gain is 5.33 dBi. At θ=85°, the gain is 5.32 dBi.

At 2400 MHz frequency point, the maximal gain being 7.15 dBi, direction is θ=70°. At θ=60°, the gain is 6.65 dBi. At θ=85°, the gain is 5.53 dBi.

At 2500 MHz frequency point, the maximal gain being 6.13 dBi, direction is θ=75°. At θ=60°, the gain is 5.76 dBi. At θ=85°, the gain is 4.39 dBi.

Figure 7:
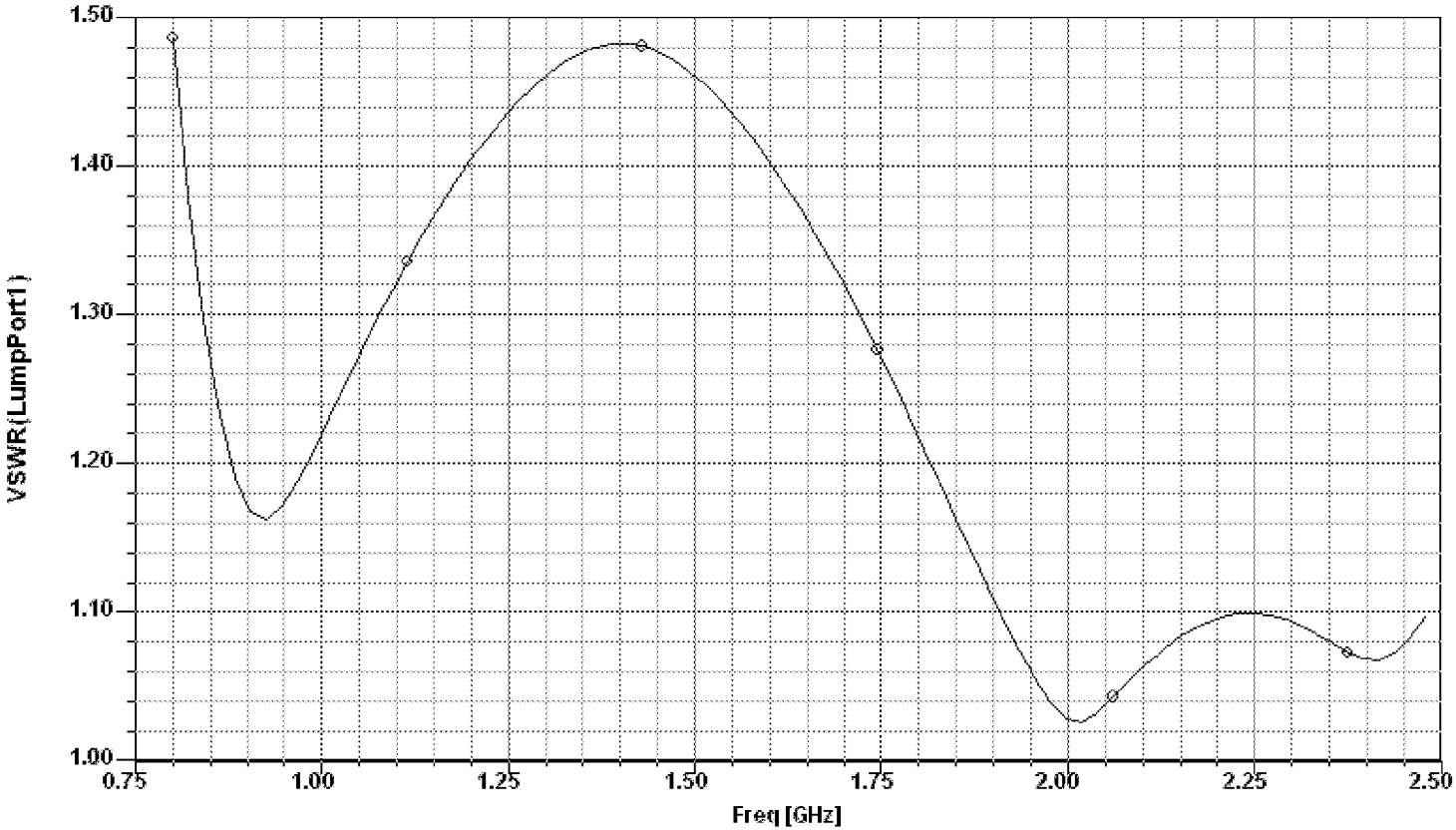
FIG. 7 is VSWR vs frequency curve of the present invention.

FIG. 7 is a simulation standing wave-frequency curve of reference size provided by the present invention, reflecting that the antenna is within a range of 800~2500 MHz, and the voltage standing wave ratio is less than 1.5.

The testing with samples which produced by the simulation model gives the result that, the radiation patterns in vertical plane is substantially the same as the simulations. The voltage standing wave ratios are all less than 1.5 in 800~3000 MHz frequency bands, and a high end of the frequency bandwidth extends by 500 MHz for the sake of WLAN input and a revolution of a mobile network toward LTE to avoid the future reconstruction.

For the convenience of comparison, the existing omnidirectional ceiling-mount antennas with a better quality are tested at the same time. The following is the statistic of test results, wherein antennas marked with "new type" is the one of the present invention, while antennas marked with "convention" is the existing ceiling-mount omnidirectional antenna.

Contrast of Test Table of Ceiling-Mount Omnidirectional Antenna

| Measure Frequency | Gain at Radiating Angle of 30° (dBi) | | | Gain at Radiating Angle of 70° (dBi) | | | Gain at Radiating Angle of 85° (dBi) | | | Unroundness at radiating angle of 85° (dB) | | |
|---|---|---|---|---|---|---|---|---|---|---|---|---|
| Point (MHz) | New Type | Convention | Improvement Value | New Type | Convention | Improvement Value | New Type | Convention | Improvement Value | New Type | Convention | Improvement Value |
| 800 | −3.97 | −2.97 | −1.00 | | | | 0.87 | 1.12 | −0.25 | 0.63 | 0.60 | 0.03 |
| 824 | −3.62 | −3.00 | −0.62 | | | | 1.13 | 1.24 | −0.11 | 0.39 | 0.60 | −0.21 |
| 840 | −3.86 | −2.99 | −0.88 | | | | 0.87 | 1.08 | −0.21 | 0.39 | 0.60 | −0.21 |
| 870 | −3.78 | −2.93 | −0.85 | | | | 1.10 | 1.20 | −0.10 | 0.49 | 0.70 | −0.21 |
| 900 | −3.52 | −3.26 | −0.26 | | | | 1.10 | 1.14 | −0.04 | 0.53 | 0.55 | −0.03 |
| 930 | −2.96 | −2.75 | −0.21 | | | | 0.96 | 0.94 | 0.02 | 0.68 | 0.60 | 0.08 |
| 960 | −2.31 | −2.16 | −0.15 | | | | 1.05 | 0.98 | 0.07 | 0.53 | 0.70 | −0.18 |
| Average in Low Frequency Band | −3.43 | −2.87 | −0.57 | | | | 1.01 | 1.10 | −0.09 | 0.52 | 0.62 | −0.11 |
| 1710 | −2.60 | 4.04 | −6.64 | 4.23 | 1.89 | 2.34 | 2.36 | −0.58 | 2.93 | 0.78 | 2.10 | −1.33 |
| 1795 | −5.27 | 4.36 | −9.62 | 4.04 | 0.51 | 3.53 | 2.50 | −1.97 | 4.47 | 0.78 | 2.60 | −1.83 |
| 1880 | −10.29 | 4.96 | −15.25 | 3.70 | 1.54 | 2.16 | 2.45 | −1.73 | 4.18 | 0.58 | 2.25 | −1.68 |
| 1920 | −11.07 | 4.69 | −15.76 | 3.98 | 1.95 | 2.04 | 2.70 | −1.99 | 4.69 | 0.54 | 2.10 | −1.56 |
| 2045 | −7.89 | 5.21 | −13.10 | 4.55 | 2.07 | 2.48 | 3.27 | −3.31 | 6.58 | 0.56 | 2.25 | −1.69 |
| 2170 | −4.80 | 5.27 | −10.07 | 4.26 | 0.45 | 3.81 | 2.65 | −3.94 | 6.59 | 0.78 | 1.55 | −0.78 |
| 2300 | −3.25 | 5.18 | −8.43 | 3.76 | −0.63 | 4.38 | 1.85 | −2.30 | 4.14 | 0.79 | 2.15 | −1.36 |
| 2400 | −2.60 | 5.09 | −7.68 | 3.76 | 0.02 | 3.74 | 1.65 | −1.20 | 2.84 | 0.74 | 2.55 | −1.81 |
| 2500 | −1.72 | 5.00 | −6.73 | 3.89 | 0.71 | 3.18 | 1.37 | −0.18 | 1.54 | 0.85 | 3.25 | −2.40 |
| Average in High Frequency Band | −5.50 | 4.87 | −10.36 | 4.02 | 0.95 | 3.07 | 2.31 | −1.91 | 4.22 | 0.71 | 2.31 | −1.60 |

Guangzhou Quality Supervision and Testing Center for Mobile Communication Products of MII of PRC year month day On-site test for actual application of the products of the present invention demonstrate that the signal strength at coverage edge is stronger than that of existing antenna by 3~6 dB.

According to the test result, within a range of attention angles of θ=60°~85°, the gain of the antenna of the present invention in low frequency band is substantially the same as the existing antenna; in high frequency band, the maximal gain is adjusted to a radiating angle of about θ=70°. In high frequency band, at θ=85° corresponding to coverage edge (about 23 meters), the average gain of the present invention is 2.31 dBi, higher by 4.22 dB than the gain (−1.91 dBi) of the existing ceiling-mount omnidirectional antenna, that is, driven by the same source power, the signal at target coverage edge are strengthened by 4.22 dB, equivalent to that the coverage area or the source power is increased by 2.6 times, particularly in 3G frequency band (1920~2170 MHz), the gain at radiating angle of 85° is increased by 4.69~6.59 dB, and the signal coverage edge is increased by 2.944.56 times. The average value of un-roundness at a radiating angle of 85° is 0.71, lower by 1.6 dB than the existing ceiling-mount omnidirectional antenna, equivalent to that the signal strength difference at the coverage edge is reduced by 3.2 dB. At a radiating angle of θ=30°, the average gain is −5.5 dBi, lower by 10 dB than the existing ceiling-mount omnidirectional antenna, equivalent to that electromagnetic radiation just under the antennas is reduced by 10 times.

The measured results demonstrate that the antenna of the present invention improves characteristics of radiation in high frequency band with the following technical effects:

1. The gain is increased at high radiating angle. The maximal gain radiating angle is increased to more than 70°. The gain is increased by 2~3 dB at radiating angle of 85°. Compared with the existing ceiling-mount omnidirectional antenna, in high frequency band, the gain of the antenna is increased by 3~6 dB within a range of radiating angles of 60°~85°, thereby increasing the signal strength at target coverage region relatively far away from the antenna and alleviating the path loss of the signal to make signal distribution more even. The gain is increased by 4.22 dB at a radiating angle 85° on average, particularly, the signal strength at the coverage edge in 3G frequency band is increased by 4.69~6.59 dB, increasing the signal strength at coverage edge and enlarging the effective coverage radius. As a result, the signal coverage is more uniform and the coverage region is enlarged by more than three times. Thus, a design principle "low power, abundant antennas" for 3G indoor distribution has been changed, that is, the amount of antennas in indoor distribution system is reduced by times, indoor distribution system is simplified and the investment and the difficulty for construction are reduced. Taking all scenarios of indoor distribution into consideration, the investment saved for indoor ceiling-mount omnidirectional antenna of the present invention is more than 30%.

2. The gain in high frequency band decreases at a low radiating angle and the gain actually measured is less than −5 dB at a radiating angle of 30°. Compared with the existing ceiling-mount antenna, the gain decreases more than 10 dB at a radiating angle being less than 30°, the strongest radiating angle increases to more than 70°, and the strength of the radiation decreases more than 9 dB.

The hygienic standards for environmental electromagnetic radiation limits the maximal input power to the antenna for indoor distribution. China National standards GB9175-88 set limits for environmental electromagnetic radiation, a first level standards for 300 MHz-300 GHz microwave radiation (applying to areas where people inhabit, work and live): less than 10 μw/cm$^2$, a second level standards (applying to areas such as lift, underground garage and so on): less than 40 μw/cm$^2$. In addition, CDMA technique for 3G system is a self-interference system in the same frequency band. To avoid the situation that a user terminal whose path loss is too small that depresses sensitivity of the receiver of a base station too much, the antenna input power for indoor distribution system is limited by the minimum coupling loss at the same time. As for the existing ceiling-mount omnidirectional antenna, a total power of the antenna input power for 3G system is generally required less than 15 dBm, and its CPICH power less than 5 dBm. The antenna of the present invention decreases radiations under the antenna, and the strongest radiating angle is increased to more than 70°, lower by 9 dB compared with the existing ceiling-mount omnidirectional antenna. Therefore, the maximal permissible value of antenna input power is increased by more than 9 dB.

3. The un-roundness of the antenna decreases, in full frequency bands it can be controlled within 1 dB. As a result, the signal distribution is more uniform and stable and the coverage can be controlled more easily. Compared with the existing ceiling-mount antenna, in high frequency band, the un-roundness index increases about 1.5 dB at a radiating angle of 85°, equivalent to that the signal strength difference at coverage radius edge is reduced by 3 dB.

4. Raise efficiency, save energy and protect environment. Compared with conventional antenna, the indoor ceiling-mount omnidirectional antenna of the present invention focuses 3G signal power within radiating angles of 60~85° and the gain increases 4.69~6.59 dB at the radiating angle of 85°. As a result, the utilization rate of signal power source is increased by 2.94~4.56 times, sources and affiliated equipments decrease and energy consumption are reduced. Meanwhile, as for signal in high frequency band, the signal strength decreases by more than 10 dB within a radiating angle of 30°, which weakens electromagnetic radiation under the antenna and effectively alleviates the problem of too strong radiation near antenna. Or vice versa, this makes room for increasing the strength of radiations under the antenna.

5. Realize covering 2G and 3G networks synchronously. The indoor ceiling-mount omnidirectional antenna of the present invention enlarges the coverage of signal in high frequency. Combined with that the maximal permissible value of antenna input power increases 9 dB, the maximal CPICH power can reach up to 14 dBm. Therefore, antenna input power can be designed flexibly and coverage radius can be designed properly, which makes the coverage of a single antenna of wireless networks by different systems and different coverage edge signal strength requirements stay in consistency with each other. As a result, the thorny issue of asynchronous coverage of 2G and 3G networks can be solved, which makes the reconstruction for 3G indoor distribution more easily just replacing the existing ceiling-mount omnidirectional antennas by that of present invention. It provides technical supports for commonly sharing indoor distribution antenna system by combining multi-system signals into indoor distribution system, and for joining forces to construction and sharing the communication infrastructures of indoor distribution system by telecommunication operators in order to avoid wasting of repeating construction and to raise utilization rate of communication infrastructural resources.

INDUSTRIAL APPLICABILITY

1. The existing 2G indoor distribution system can be reconstructed by only replacing antennas by the antennas of the present invention for 3G network. At the coverage edge, the signal strength stays the same in low frequency band and increases 3~6 dB in high frequency band. As for the case of a original 2G indoor distribution system that the 2G signal coverage is good, but the 3G signal coverage is relatively weak after adding 3G source, By just replacing the antennas, satisfactory coverage of 3G signal can be achieved, this avoids a big engineering reconstruction of increasing a number of the antennas and reduces the difficulty of negotiation with estate owner.

2. As for the reconstruction of the existing 2G indoor distribution system for the 3G network, by replacing the original antennas by the antennas of the present invention instead of adding more antennas, only ½~¼ of the source power is needed to achieve the same 3G signal coverage. Therefore, for a large indoor distribution system that several remote radio units (RRU), repeaters or trunk amplifiers are required for power distribution, only one RRU source may supply for that. So, it reduces the investment of signal source dramatically and avoids the losses of the signal quality and capacity caused by cell handoff between RRUs. It also saves electricity power consumption and reduces the cost for maintenance.

3. As for constructing a new indoor distribution system for 3G network, by using the antenna of the present invention, the design principle of "low power, abundant antennas" has been changed, as a results, the space between the distributed antennas are much increased, the power of the source is reduced, the coverage of a single RRU is enlarged, the number of passive devices such as the antennas and the feeder and sources such as RRU and trunk amplifiers are decreased, and the investment for the engineering construction of the indoor distribution system is reduced.

4. By properly designing the covering radius and the antenna aperture power, the antenna of the present invention can achieve a synchronous coverage of 2G and 3G networks to share the antenna and cable distribution system; it also can make multi-frequency bands and systems meet the required coverage edge signal strength. This provides technical supports for commonly sharing indoor distribution antenna system by combining multi-system signals into indoor distribution system, and for joining forces to construction and sharing the communication infrastructures of indoor distribution system by telecommunication operators in order to avoid wasting of repeating construction and to raise utilization rate of communication infrastructural resources.

5. The antenna of the present invention "diminishes superabundance, and supplements deficiency". In high frequency band, it reduces the gain at a low radiating angle, increases the gain at a high radiating angle, and also improves un-roundness. The signal distribution is more uniform and stable, and the radiation just under the antennas is weaker and more eco-friendly.

6. The antenna structure of the present invention is simple. The grounding and impedance matched sheet(s) of the conventional antenna are cancelled for the antenna, requiring no impedance adjustment, easy to assemble and good consistency, Which are beneficial for mass-production and product quality control.

What is claimed is:

1. An indoor ceiling-mount omnidirectional antenna, comprising:

a monopole having a conical-column structure, the monopole including a first cone part having a first small base and a first large base, and a columnar part, wherein the first cone part includes a first hollow platform cone, the first columnar part includes a first hollow column, the monopole further comprises a feed column connected with the first small base of the first cone part, and an outer radius of the first columnar part is the same as a first radius of the first large base of the first cone part, a reflecting plate having disc-cone structure and arranged below the monopole, the reflecting plate including:

a second cone part having a second small base and a second large base, and a disc, wherein:

the disc comprises a circular plate and a second hollow column, the second cone part including a second hollow platform cone, an inner radius of the circular plate is the same as an outer radius of the second hollow column, the outer radius of the second hollow column is the same as a second radius of the second large base of the second cone part, and the circular plate, the second hollow column, and the second hollow platform cone are connected to each other; and a feed connector, disposed in a center of the second small base of the second cone and connecting with a feed coaxial line, for receiving and emitting signal feed-in or feed-out, wherein the monopole and the reflecting plate are arranged such that the first small base of the first cone part faces the second small base of the second cone part.

2. The ceiling-mount omnidirectional antenna of claim 1, wherein tapers of said first cone part and said second cone part are adjusted so that a maximal gain appears within a range of radiating angles of 60~85° for a full frequency band including a high frequency band and a low frequency band.

3. The ceiling-mount omnidirectional antenna of claim 1, wherein the feed coaxial line is a 50Ω coaxial line.

4. The ceiling-mount omnidirectional antenna of claim 1, wherein an outer layer of the feed connector is fixed to and connected with the reflecting plate.

5. The ceiling-mount omnidirectional antenna of claim 1, wherein the feed column is connected with a core wire of the feed connector, and the feed connector is connected with the feed coaxial line.

6. The ceiling-mount omnidirectional antenna of claim 1, wherein a total length of the monopole is equivalent to a quarter of a wavelength of 800 MHz electromagnetic wave multiplying a coefficient of contraction.

7. The ceiling-mount omnidirectional antenna of claim 6, wherein a quarter of a wavelength of 800 MHz electromagnetic wave is 93.75 mm, a value range of a coefficient of contraction is 0.4-1.0.

8. A method for manufacturing an indoor ceiling-mount omnidirectional antenna, comprising:

disposing a monopole having a conical-column structure, the monopole including:

a first cone part having a first small base and a first large base, a columnar part, wherein:

the first cone part includes a first hollow platform cone, the first columnar part includes a first hollow column, the monopole further comprises a feed column connected with the first small base of the first cone part, and an outer radius of the first columnar part is the same as a first radius of the first large base of the first cone part, disposing a reflecting plate having disc-cone structure and arranged below the monopole, the reflecting plate including:

a second cone part having a second small base and a second large base, and a disc, wherein:

the disc comprises a circular plate and a second hollow column, the second cone part includes a second hollow platform cone, an inner radius of the circular plate is the same as an outer radius of the second hollow column, the outer radius of the second hollow column is the same as a second radius of the second large base of the second cone part, and the circular plate, the second hollow column, and the second hollow platform cone are connected to each other, and disposing a feed connector in a center of the second small base of the second cone part and connecting with a feed coaxial line, for receiving and emitting signal feed-in or feed-out, wherein the monopole and the reflecting plate are arranged such that the first small base of the first cone part faces the second small base of the second cone part.

9. The method of claim 8, further comprising:

adjusting taper angles and scales of the monopole and the reflecting plate to adjust a radiating angle of a maximal gain of the antenna in a high frequency band to decrease a gain at a low radiating angle and increase the gain at a high radiating angle.

10. The method of claim 9, further comprising:

adjusting sizes and scales of the monopole and the reflecting plate to ensure impedances match in full frequency bands and to control a voltage standing wave ratio to be below 1.5.

11. The method of claim 10, wherein adjusting the sizes and the scales of the monopole and the reflecting plate includes adjusting the sizes and the scales of the monopole and the reflecting plate to ensure that a signal power in the high frequency band focuses within a range of radiating angles of 60~85°.

12. The method of claim 11, wherein adjusting the sizes and the scales of the monopole and the reflecting plate includes adjusting the sizes and the scales of the monopole and the reflecting plate to ensure that the maximal gain of the antenna in the high frequency band appears at a radiating angle of about 70°.

13. The method of claim 11, wherein adjusting the sizes and the scales of the monopole and the reflecting plate includes adjusting the sizes and the scales of the monopole and the reflecting plate to increase the gain in the high frequency band at a radiating angle of 85° so that coverage of the antenna is basically the same for different frequencies.

14. The method of claim 9, wherein adjusting the taper angles and the scales of the monopole and the reflecting plate includes adjusting the taper angles and the scales of the monopole and the reflecting plate to ensure that a signal power in the high frequency band focuses within a range of radiating angles of 60~85°.

15. The method of claim 14, wherein adjusting the taper angles and the scales of the monopole and the reflecting plate includes adjusting the taper angles and the scales of the monopole and the reflecting plate to ensure that the maximal gain of the antenna in the high frequency band appears at a radiating angle of about 70°.

16. The method of claim 14, wherein adjusting the taper angles and the scales of the monopole and the reflecting plate includes adjusting the taper angles and the scales of the monopole and the reflecting plate to increase the gain in the high frequency band at a radiating angle of 85° so that coverage of the antenna is basically the same for different frequencies.

* * * * *